United States Patent [19]

Ferich

[11] 4,048,767

[45] Sept. 20, 1977

[54] BATHROOM PARTITIONS

[76] Inventor: Joseph Ferich, 10917 St. Mark, Cleveland, Ohio 44111

[21] Appl. No.: 679,013

[22] Filed: Apr. 21, 1976

[51] Int. Cl.[2] ..... A47K 3/16

[52] U.S. Cl. ..... 52/35; 52/220; 52/281; 52/265

[58] Field of Search ..... 52/34, 35, 220, 221, 52/434, 281, 239; 35/60; 220/22.5, 22.3; 312/111, 257 A, 257 SK, 265

[56] References Cited

U.S. PATENT DOCUMENTS

| | | | |
|---|---|---|---|
| 1,311,229 | 7/1919 | Hughes | 52/281 |
| 2,065,433 | 12/1936 | Dercum | 52/220 |
| 3,181,660 | 5/1965 | Langtry | 52/239 |
| 3,252,260 | 5/1966 | Mills | 52/308 |
| 3,842,556 | 10/1974 | Brendgord | 52/34 |
| 3,857,619 | 12/1974 | Adickes | 312/111 |

FOREIGN PATENT DOCUMENTS

| | | | |
|---|---|---|---|
| 253,753 | 4/1967 | Austria | 52/584 |
| 1,341,653 | 4/1963 | France | 52/306 |
| 2,017,737 | 5/1970 | France | 52/34 |
| 1,458,831 | 11/1966 | France | 52/586 |
| 375,300 | 2/1963 | Switzerland | 52/34 |
| 1,295,072 | 11/1972 | United Kingdom | 52/34 |
| 1,096,218 | 12/1967 | United Kingdom | 52/584 |

*Primary Examiner*—Price C. Faw, Jr.
*Assistant Examiner*—Henry Raduazo
*Attorney, Agent, or Firm*—Meyer, Tilberry & Body

[57] ABSTRACT

A preformed hollow partition of plastic sheet material is disclosed for attachment to horizontal and vertical studs on the floor and wall of a bathroom to associate the partition with the plumbed end of a bathtub fixture. The partition is generally rectangular and is open along the bottom edge and one side edge thereof to receive the corresponding stud to which the partition is fastened for support. The side of the partition facing the tub is cut on site to accommodate the edge flange on the end of the tub and to provide openings for faucet, water valve and shower fittings. The opposite side of the partition is provided with an access opening to facilitate plumbing work.

8 Claims, 6 Drawing Figures

BATHROOM PARTITIONS

The present invention relates to the art of partitions and, more particularly, to a preformed plastic partition installed in a bathroom at one end of a bathtub.

In connection with the building or remodeling of bathrooms, and especially the remodeling of bathrooms in older homes, it often becomes necessary or desirable for functional and aesthetic purposes to provide a partition at one end of a bathtub. In this respect, the bathtub often is positioned in a corner of the bathroom with the plumbed end of the tub exposed. The existing water lines come up through the floor of the room and accordingly are also visible. In connection with the remodeling project in such a situation, it is desirable, especially from the standpoint of economics, to retain the water lines and drain line in their existing locations in the room. To do so and provide an attractive appearance in the bathroom at the plumbed end of the tub, it becomes necessary to construct a partition wall through which the water lines can extend and which will accommodate the corresponding end of the new bathtub. If it is desired to provide a shower capability in connection with such a remodeling project, it becomes necessary to construct a partition of sufficient height to accommodate the shower head. In any event, the standard construction of such a partition through the use of studs, plasterboard, and the necessary surface finish such as tile is a time consuming and thus expensive endeavor, independent of the cost of the necessary materials. In this respect, a plumber or contractor can spend two, three or more days constructing such a partition. It will be appreciated that both sides of the partition must be finished for aesthetic purposes.

In accordance with the present invention, a preformed hollow partition of plastic sheet material is provided for mounting in the bathroom at the plumbed end of a bathtub which enables a considerable reduction in cost and installation time. In particular, installation simply requires fastening a support stud to the vertical room wall at the plumbed end of the tub, fastening a support stud on the floor adjacent the tub end, and positioning and fastening the partition to the support studs. One side of the partition is readily scribed and cut to receive the edge flange at the plumbed end of the tub, and the same side of the partition is readily scribed and cut to provide openings for faucet, water valve and, if desired, a shower fixture. The opposite side of the partition is provided with an access opening to facilitate the necessary plumbing work.

As will become apparent hereinafter, the partition can be readily fabricated by molding or shaping plastic sheet material to the desired configuration, or by molding or shaping partition sections and welding or otherwise bonding the sections together to define the partition structure. In any event, the partition is comprised of a pair of panels having top, bottom, inner and outer side edges with respect to the tub, and the partition is closed along the top and outer edges and is open along the inner and bottom edges. In accordance with a preferred embodiment, mounting strips are provided inwardly of the open edges of the partition to define recesses receiving the support studs, and the mounting strip along the inner edge of the partition is provided with key slots for receiving fasteners prepositioned on the upright support stud. Accordingly, the partition is readily mounted by introducing the fasteners through the key slots and then dropping the partition into position with respect to the support stud on the floor. The partition is readily fastened to the latter such as by nails hammered through the overlying mounting strip which is accessible through the plumbing access door. Installation of the partition is thus complete, and all that remains is to do the necessary plumbing work and to appropriately seal the juncture between the partition and the tub and bathroom wall.

It is accordingly an outstanding object of the present invention to provide a preformed hollow partition of plastic sheet material for installation in a bathroom in association with the end of a bathtub fixture.

Another object is the provision of a partition of the foregoing character which is economical to produce and install.

Another object is the provision of a partition of the foregoing character which requires just two support members of readily available construction materials to achieve installation thereof.

Another object is the provision of a partition of the foregoing character which is readily scribed and cut to accommodate the dimensions and contour of a given bathtub and water supply fixtures associated therewith.

The foregoing objects, and others, will be in part obvious and in part pointed out more fully hereinafter in conjunction with the ensuing description of the drawings showing a preferred embodiment of the invention and in which.

Figure 1:
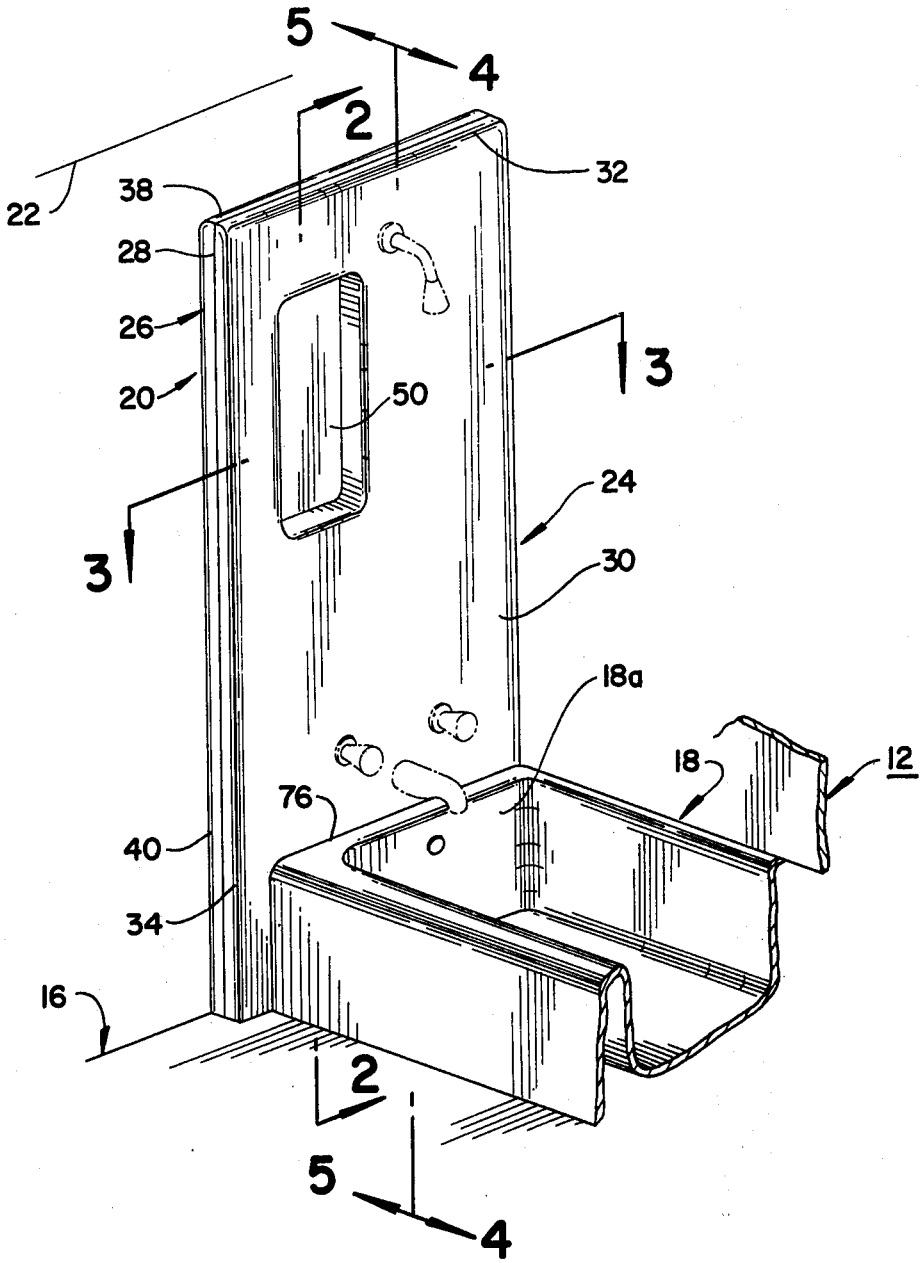
FIG. 1 is a perspective view showing a partition in accordance with the present invention associated with a bathtub.
Figure 3:
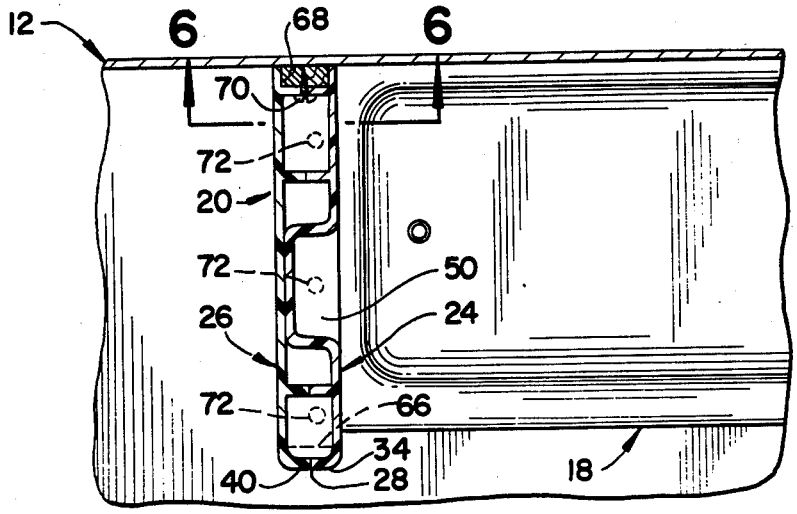
FIG. 3 is a plan view in section of the partition taken along line 3—3 in FIG. 1.
Figure 2:
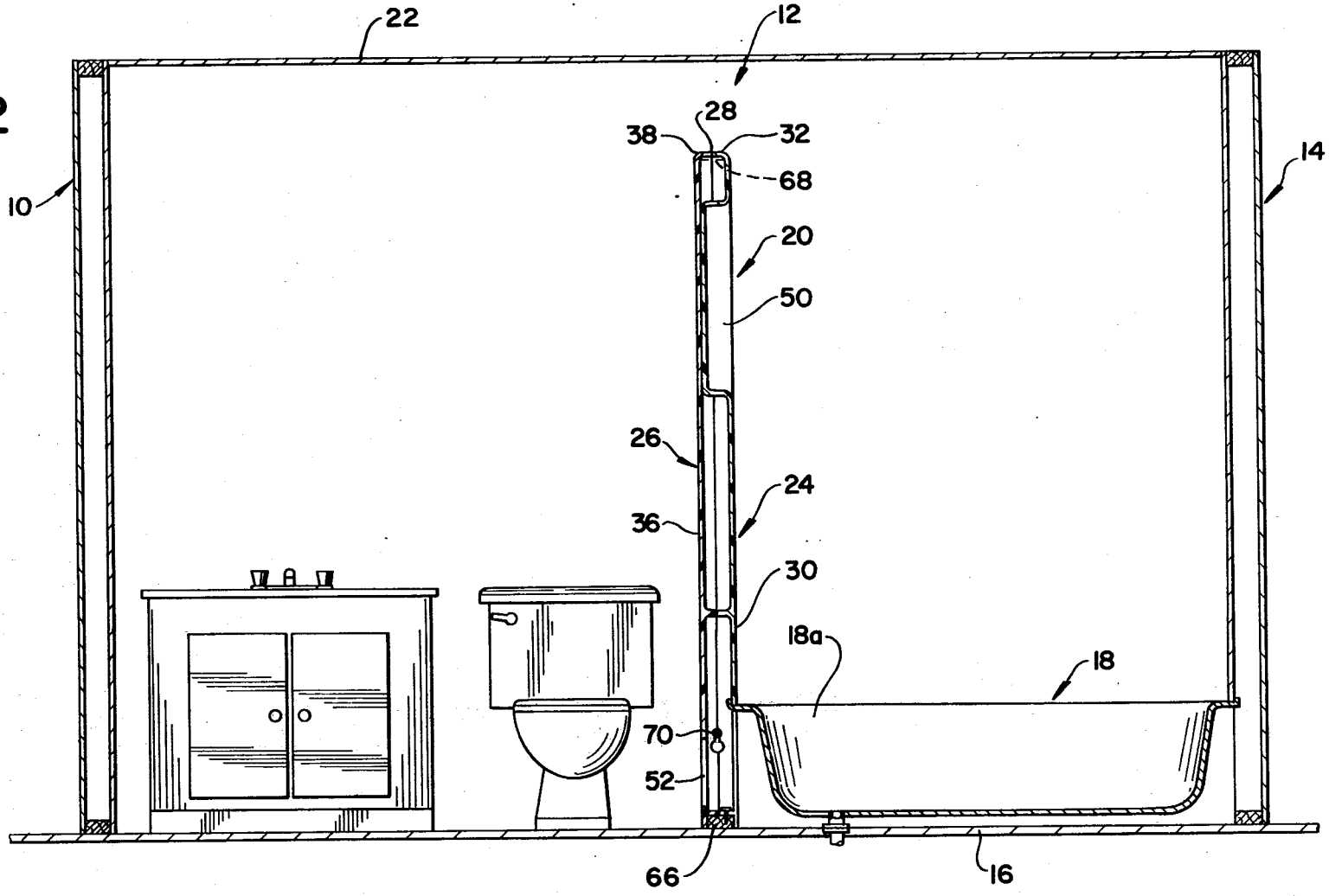
FIG. 2 is a sectional elevation view taken along line 2—2 in FIG. 1 and showing the partition and tub in association with a bathroom.

Referring now in greater detail to the drawings wherein the showings are for the purpose of illustrating a preferred embodiment of the invention only, and not for the purpose of limiting the invention, FIGS. 1–3 depict a bathroom including upright walls 10, 12 and 14, and a floor 16. A bathtub 18 is disposed in the corner between walls 12 and 14 and has its plumbed end **18*a* disposed within the room between walls 10 and 14. Partition 20 of the present invention is positioned at the plumbed end of tub 18 and extends from floor 16 to a location spaced below ceiling line 22 of the bathroom, and extends outwardly from wall 12 to a location beyond the outer edge of tub 18.** Existing water supply lines, not shown, generally extend upwardly through the floor so as to be positioned to extend into the interior of the partition from therebeneath or from a location adjacent the bottom of the partition and toward the tub.

Figure 4:
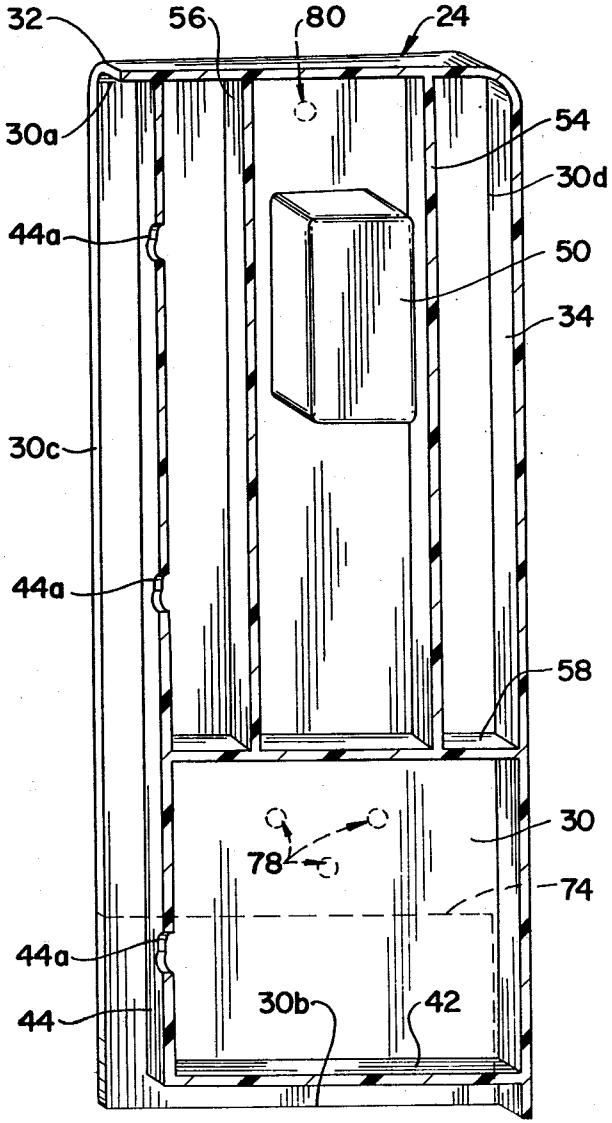
FIG. 4 is a perspective view of a portion of the partition as seen when looking in the direction of line 4—4 in FIG. 1.
Figure 5:
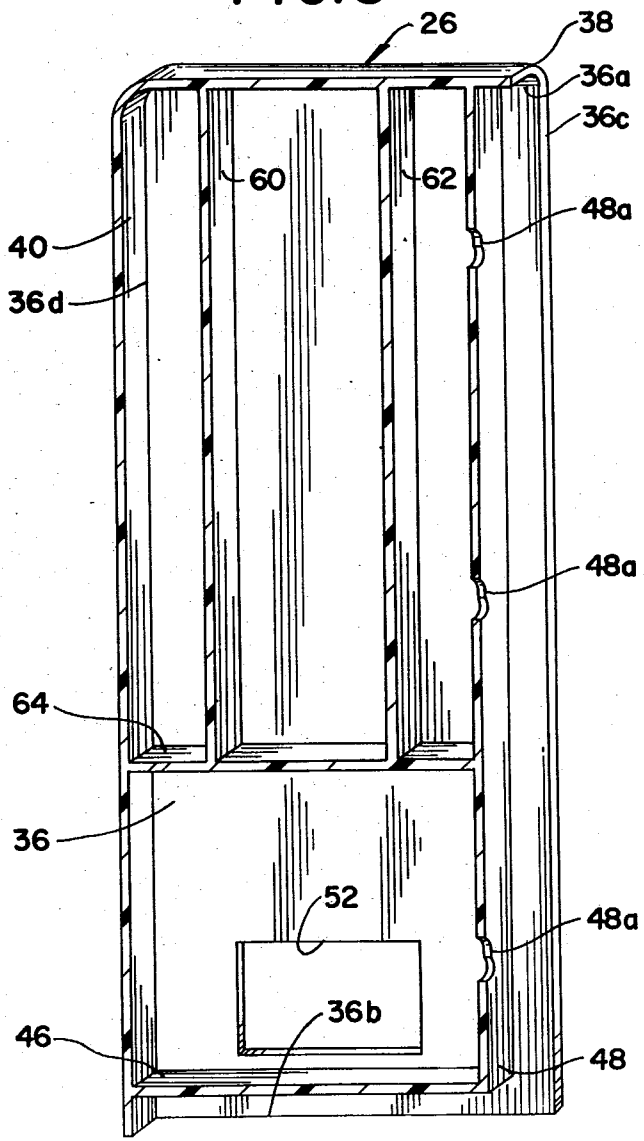
FIG. 5 is a perspective view of a portion of the partition as seen when looking in the direction of line 5—5 in FIG. 1.

Partition 20, in accordance with the preferred embodiment, is comprised of two partition sections 24 and 26, shown in FIGS. 4 and 5, which are heat sealed or otherwise bonded together along a seam 28 therebetween to form a partition unit. As best seen in FIGS. 4 and 5, section 24 is generally rectangular and includes a panel 30 having a top edge **30*a*, a bottom edge 30*b*, an inner edge 30c with respect to tub 18, and an outer edge 30d. Section 24 further includes a wall portion 32 along top edge 30a from inner edge 30c to outer edge 30d, and a wall portion 34 which is integral with wall portion 32 and which extends along outer edge 30d of panel 30 to bottom edge 30b thereof. Similarly, section 26 is comprised of a panel 36 which is generally rectangular and includes top edge 36a, bottom edge 36b, inner edge 36c and outer edge 36d. Wall portion 38 extends along top edge 36a from inner edge 36c to outer edge 36d, and wall portion 40 is integral with wall portion 38 and extends along outer edge 36d of panel 36 to bottom edge 36b thereof. When sections 24 and 26 are welded together, panel 30 defines a front panel with respect to the tub, panel 36 defines a rear panel with respect to the tub, wall portions 32 and 38 close the top edges of the panels, and wall portions 34 and 40** close the outer side edges of the panels.

Figure 6:
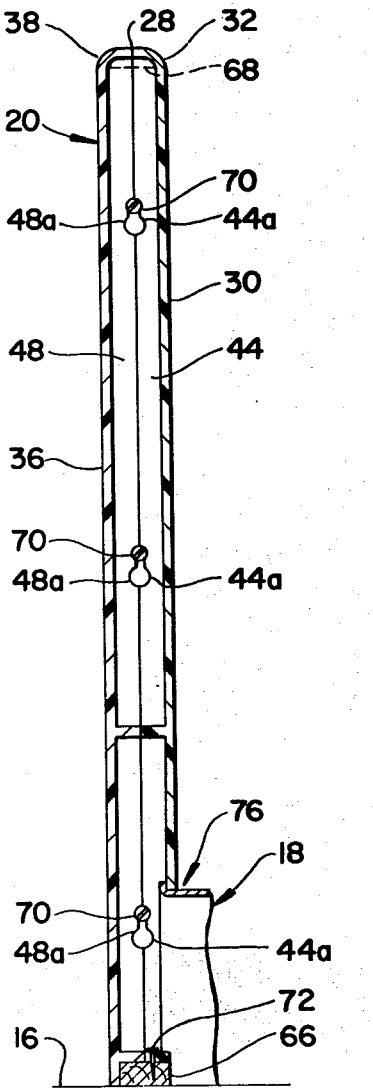
FIG. 6 is a sectional elevation view of the partition taken along line 6—6 in FIG. 3.

Preferably, as seen in FIGS. 4 and 5, section 24 is provided with a mounting strip 42 parallel to bottom edge 30b and extending from wall portion 34 toward inner edge 30c of panel 30. Further, section 24 is provided with a mounting strip 44 extending parallel to inner edge 30c of panel 30 and from wall portion 32 toward bottom edge 30b. Each of the mounting strips is integral with panel 30 and with one another at the location of the juncture therebetween, and each is shaped inwardly from the corresponding edge of panel 30 for the purpose set forth hereinafter. Similarly, partition section 26 is provided with a mounting strip 46 parallel to bottom edge 36b of panel 36 and a mounting strip 48 parallel to inner edge 36c of the panel. Mounting strips 46 and 48 are each spaced inwardly from the corresponding edges of panel 36 and are respectively aligned with mounting strips 42 and 44 when sections 24 and 26 are joined together. Mounting strip 44 is provided with a plurality of key slot recesses 44a, and mounting strip 48 is provided with a corresponding plurality of key slot recesses 48a. Recesses 44a and 48a are aligned with one another when the partition sections are interconnected and together define a plurality of key slots as seen in FIG. 6. The function of the key slots is described more fully hereinafter.

In accordance with the present embodiment, panel 30 is provided with an integral recess 50 formed therein to provide a shelf area, mirror support or the like and panel 36 of section 26 is provided with an access opening 52 therethrough for the purpose set forth hereinafter. While the access opening is shown as being precut in panel 36, it will be appreciated that the access opening could be cut therethrough upon installation of the partition. Additionally, each of the partition sections is preferably provided with reinforcing ribs such as ribs 54, 56 and 58 for section 24 and corresponding ribs 60, 62 and 64 for section 26. Such reinforcing ribs preferably are integral with the corresponding panel and wall portions.

Installation of partition 20 is simple, as will be appreciated from the following description with reference to FIGS. 1–6. In this respect, a mounting stud 66, preferably a standard wooden two-by-four of appropriate length, is nailed or other wise attached to floor 16 so as to extend perpendicular to wall 12 of the bathroom. A second mounting stud 68, preferably a standard wooden two-by-four of appropriate length with respect to the vertical height of partition 20, extends vertically along bathroom wall 12 from the corresponding end of stud 66 and is nailed or otherwise suitably attached to wall 12. It will be appreciated, therefore, that the two mounting studs provide an L-shaped mounting and support arrangement. Partition panels 30 and 36 have inner surfaces preferably spaced apart a distance corresponding to the standard width of a two-by-four, and mounting strips 42 and 46 adjacent the bottom edges of the panels and mounting strips 44 and 48 adjacent the inner edges of the panels are spaced inwardly of the bottom and inner edges of the panels a distance corresponding to the standard thickness of a two-by-four. Accordingly, the mounting strips and the corresponding portions of the panels between the mounting strips and panel edges cooperatively define recesses along the bottom and inner edges of the partition which receive the corresponding mounting stud.

In the embodiment shown, mounting stud 68 is provided with a plurality of headed fasteners 70, such as lag bolts or the like, and each of which is adapted to pass through the enlarged lower portion of a corresponding key slot provided in mounting strips 44 and 48. Thus, upon lowering the partition, the shanks of the fasteners are received in the smaller portions of the key slots so that the heads of the fasteners engage the mounting strips adjacent the key slots to retain the partition against bathroom wall 12. When the partition is so positioned with respect to support stud 68, mounting strip portions 42 and 46 overlie support stud 66. All that is necessary to complete the installation is to secure the partition to stud 66 such as by nails, screws or the like 72 driven through the mounting strip and into stud 66. Access to the mounting strip for this purpose is provided by access opening 52 in panel 36 of partition section 26.

Prior to attachment of the partition to mounting studs 66 and 68, the partition is suitably positioned adjacent the end of tub 18 and the contour of the end of the tub is suitably scribed on panel 30, as indicated by broken line 74 in FIG. 4. The portion of panel 30 within line 74 is removed by cutting the panel along the scribed line and along the lines of juncture between panel 30 and mounting strips 42 and 44 so that the latter remain as an integral part of the partition. This provides an opening 76 in the partition adapted to receive the edge flange of tub 18. This also opens the lower front portion of panel 30 for extending the water supply lines into the partition if the existing lines come through the floor at a location spaced from the partition toward the tub. Once the partition is installed, the necesary openings for faucet, valve and shower head fixtures can be cut in panel 30 at the desired locations therefor. For example, in FIG. 4 proposed locations for faucet and valve openings are designated generally by numeral 78, and a proposed shower head fixture opening is designated generally by the numeral 80. In FIG. 1, faucet, valve and shower head fixtures are shown in phantom at the locations corresponding to the proposed openings shown in FIG. 4.

The material from which the partition is produced and the thickness thereof will of course vary depending on the overall dimensions of the partition, the degree of rigidity desired, and the extent to which the partition is internally reinforced such as by reinforcing ribs therein. Many plastic materials could be used and would be obvious for the intended purpose. For example, polyvinyl chloride would be quite suitable and would be advantageous from the standpoint of economy. It will be further appreciated that the plastic material employed can be reinforced such as by fiberglass or the like therein to enhance the rigidity and strength without having to unduly increase the material thickness.

While the partition herein illustrated and described has a vertical height sufficient to accommodate installation of a shower head fixture, such a partition is often constructed of a vertical height just sufficient to accommodate the faucet and water valve fixtures. Accordingly, it will be appreciated that the vertical height of the partition can vary without departing from the principles of the present invention. Moreover, while the preferred embodiment shows a shelf or mirror recess in the front panel of the partition, it will be appreciated that such a recess is not necessary. The partition structure readily accommodates the provision of such a recess and, likewise, would accommodate the provision of a variety of integral configurations which could be introduced during the formation of either of the partition sections to provide functional additions to the partition such as, for example, a soap supporting recess. Still further, it will be appreciated that the outer surfaces of the partition sections can be suitably embossed during the molding or shaping process to provide a desired decorative appearance for the partition or, alternatively, that the outer surfaces of the finished partition can be provided with any suitable decorative additions for appearance purposes.

While considerable emphasis has been placed herein on the preferred structure shown in the drawings, many changes can be made in the preferred embodiment without departing from the principles of the present invention. In this respect, for example, while it is preferred to provide mounting strips along the inner and bottom edges of the partition so that the fasteners employed in mounting the partition are hidden, it will be readily apparent that the marginal side and bottom edges of the partition could be otherwise fastened to the mounting studs. For example, the marginal edges could be nailed to the sides of the studs and the exposed nail heads then covered with suitable molding strips. With such an installation procedure, the mounting strips would not be necessary. Further, while internal reinforcement through the provision of reinforcing ribs is shown in the preferred embodiment, it will be appreciated that the interior could be otherwise reinforced, such a by the provision of Styrofoam or other porous plastic blocks which could be positioned between the panels through the open side and bottom edges of the partition and, if desired, secured within the partition such as by adhesive bonding. Likewise, a suitable preformed plastic grid could be slid between the panels of the partition and secured in place therebetween such as by adhesive bonding, as opposed to producing the ribs integral with the partition portions as described herein.

Still further, it will be appreciated that the panels and the wall portions closing the top and outer side edges thereof could be produced as an integral unit rather than in sections which would be welded or adhesively bonded together. Then, if necessary or desired, internal reinforcement could be introduced between the panels as described above with regard to a preformed plastic grid, for example. It will be appreciated, however, that the necessity for such internal reinforcement would be determined at least in part by the thickness of the plastic material and the overall width and height dimensions of the partition. With further regard to producing the panel and closing wall portions as an integral unit, it will be appreciated that a preformed mounting strip unit could then be introduced adjacent the open bottom and inner side edges of the partition and welded or adhesively bonded in place to facilitate mounting the partition in accordance with the preferred mounting arrangement employing such mounting strips.

Additionally, while key slot and headed fasteners are disclosed in connection with the mounting strip along the inner side edge of the partition, it will be appreciated that other slot and fastener configurations and arrangements can be employed to achieve a desired connection between the bathroom wall and inner edge of the partition. In this respect, for example, the headed fasteners could be replaced by wedge type hooks which would extend through openings in the mounting strip along the inner edge of the partition so as to draw the partition into tight engagement with the bathroom wall upon displacement of the partition downwardly relative to the wall. Many suitable fastening arrangements for achieving interconnection of the partition with the bathroom wall and floor will be obvious and suggested from the embodiment described herein.

As many possible embodiments of the present invention can be made, and as many changes can be made in the embodiment herein illustrated and described, it is to be distinctly understood that the foregoing descriptive matter is to be interpreted merely as illustrative of the present invention and not as a limitation.

What is claimed is:

1. A preformed generally rectangular bathroom partition of plastic sheet material mountable on prepositioned L-shaped support member means comprising, spaced apart parallel front and rear panels having top edges, bottom edges, outer side edges and inner side edges, wall means interconnecting and closing said panels along said top and outer side edges, said panels having opposed inner surfaces, said inner surfaces being spaced apart along said bottom and inner side edges to receive said support member means therebetween, mounting means on the inner surfaces of said panels for attaching said partition to said support members, said mounting means including a first mounting strip connecting said inner surfaces of said panels and extending from said wall means along said outer side edges toward said inner side edges and a second mounting strip connecting said inner surfaces of said panels and extending from said wall means along said top edges toward said bottom edges, said second mounting strip having key slot openings therethrough, said rear panel having an access opening therethrough, and reinforcing means between the inner surfaces of said panels inwardly of said wall means and said first and second mounting strips.

2. A preformed generally rectangular bathroom partition of plastic sheet material mountable on prepositioned L-shaped support member means in which each leg of the L has given width and thickness dimensions transverse to the leg, comprising: spaced apart parallel front and rear panels having top edges, bottom edges, outer side edges and inner side edges, wall means interconnecting and closing said panels along said top and outer side edges, said bottom edges of said panels being coplanar, said inner side edges of said panels being coplanar, said wall means closing said panels along said top and outer side edges having opposite end edges one coplanar with said inner side edges and the other coplanar with said bottom edges, said panels having opposed inner surfaces, said inner surfaces being spaced apart along said bottom and inner side edges a distance equal to said width dimension of said legs of said support member means to receive said L-shaped support member means therebetween, and mounting means on the inner surfaces of said panels inwardly adjacent said bottom and inner side edges for attaching said partition to said support member means, said mounting means being spaced inwardly of said bottom and inner side edges a distance at least equal to said thickness dimension of said legs of said support means.

3. The partition according to claim 2, wherein said rear panel includes an access opening therethrough adjacent said bottom edge thereof.

4. The partition according to claim 2, and reinforcing means between the inner surfaces of said panels inwardly of said wall means and said mounting means.

5. The partition according to claim 2, wherein said partition is comprised of two sections bonded together, each section including one of said front and rear panels and a portion of said wall means therebetween.

6. The partition according to claim 2, wherein said mounting means are mounting strips between and connecting said inner surfaces of said panels.

7. The partition according to claim 6, wherein said mounting strips include a first mounting strip connecting said inner surfaces of said panels and extending from said wall means along said outer side edges toward said inner side edges, and a second mounting strip connecting said inner surfaces of said panels and extending from said wall means along said top edges toward said bottom edges.

8. The partition according to claim 7, wherein said second mounting strip has key slot openings therethrough.

* * * * *